US011391504B2

(12) United States Patent
Kawanami

(10) Patent No.: US 11,391,504 B2
(45) Date of Patent: Jul. 19, 2022

(54) REFRIGERATOR

(71) Applicant: SHARP KABUSHIKI KAISHA, Sakai (JP)

(72) Inventor: Tohru Kawanami, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 117 days.

(21) Appl. No.: 16/853,410

(22) Filed: Apr. 20, 2020

(65) Prior Publication Data

US 2020/0340730 A1 Oct. 29, 2020

(30) Foreign Application Priority Data

Apr. 24, 2019 (JP) ..... 2019-082593

(51) Int. Cl.
*F25D 29/00* (2006.01)
*F25D 17/06* (2006.01)
*F25D 21/04* (2006.01)

(52) U.S. Cl.
CPC ..... *F25D 17/065* (2013.01); *F25D 17/067* (2013.01); *F25D 21/04* (2013.01); *F25D 29/00* (2013.01); *F25D 2317/06* (2013.01); *F25D 2700/12* (2013.01)

(58) Field of Classification Search
CPC ..... F25D 11/022; F25D 17/045; F25D 17/065
See application file for complete search history.

(56) References Cited

U.S. PATENT DOCUMENTS 5,729,997 A * 3/1998 Witsoe ..... F25D 17/065 62/426
2009/0158928 A1* 6/2009 Wu ..... A47L 15/481 96/144
2009/0173100 A1* 7/2009 Kang ..... F25D 25/025 62/407
2010/0071874 A1* 3/2010 Nojima ..... F25D 17/065 165/61
2010/0147003 A1* 6/2010 Ueda ..... A23L 3/3409 239/690
2010/0154446 A1* 6/2010 Oh ..... F25D 21/04 62/129
2011/0016887 A1* 1/2011 Lee ..... F25D 25/025 62/3.2
2013/0276465 A1* 10/2013 Shin ..... F25D 17/065 62/3.6

FOREIGN PATENT DOCUMENTS

JP 2000-356445 A 12/2000

* cited by examiner

*Primary Examiner* — Filip Zec
(74) *Attorney, Agent, or Firm* — ScienBiziP, P.C.

(57) ABSTRACT

A refrigerator includes a first cooler; a freezer compartment an inside of which is cooled by circulation of cooled air subjected to heat exchange by the first cooler; and a refrigerator compartment cooled by direct-cooling, using a cooling plate, wherein the cooled air subjected to heat exchange by the first cooler is to be supplied to the refrigerator compartment.

4 Claims, 11 Drawing Sheets

REFRIGERATOR

CROSS-REFERENCE TO RELATED APPLICATION

The present application claims priority from Japanese Application JP2019-082593, filed Apr. 24, 2019, the content to which is hereby incorporated by reference into this application.

BACKGROUND OF THE INVENTION

1. Field of the Invention

An aspect of the present invention relates to a refrigerator including a refrigerator compartment mainly cooled by direct-cooling.

2. Description of the Related Art

Techniques for cooling refrigerators include direct-cooling and indirect-cooling. In the direct-cooling, a refrigerator has a metal cooling plate provided to, for example, an interior wall of the refrigerator. This cooling plate is cooled with an evaporator in a freezing cycle. Hence, the inside of the refrigerator is cooled through the cooling plate. In the indirect-cooling, the air is cooled by heat exchange with an evaporator in a freezing cycle, and the cooled air is blown to the inside of the refrigerator with, for example, a fan to cool the inside.

Compared with the indirect-cooling that involves circulating the cooled air with a fan, utilizing the direct-cooling to cool the inside of the refrigerator is advantageous since the latter can keep the inside from drying. Meanwhile, utilizing the indirect-cooling to cool the inside of the refrigerator is advantageous since the inside can be cooled quickly. Some refrigerators cool the inside utilizing both the direct-cooling and the indirect-cooling.

For example, a refrigerator disclosed in Japanese Unexamined Patent Application Publication No. 2000-356445 cools a refrigerator compartment by direct-cooling and a freezer compartment by the indirect-cooling.

SUMMARY OF THE INVENTION

In cooling vegetables in a refrigerator compartment, the inside of the refrigerator compartment is desired to be maintained at an appropriate humidity in order to keep the vegetables fresh. Hence, to cool a refrigerator compartment for vegetables, suitably adopted is the direct-cooling capable of further keeping the inside from drying.

However, if foods with a high water content at a relatively high temperature are put in the refrigerator compartment, a large amount of water vapor is generated inside the refrigerator compartment. The water vapor causes a problem of condensation on a cooling plate provided inside the refrigerator compartment.

An aspect of the present invention is intended to provide a refrigerator capable of reducing formation of condensation inside a refrigerator compartment while curbing a drop of humidity in the refrigerator compartment.

A refrigerator according to an aspect of the present invention includes: a first cooler; a freezer compartment an inside of which is cooled by circulation of cooled air subjected to heat exchange by the first cooler; and a refrigerator compartment cooled by direct-cooling, using a cooling plate. In this refrigerator, the cooled air subjected to heat exchange by the first cooler is to be supplied to the refrigerator compartment.

The refrigerator according to an aspect of the present invention may further include a temperature-humidity sensor configured to detect a temperature and a humidity of the refrigerator compartment, wherein the cooled air subjected to heat exchange by the first cooler may be supplied to the refrigerator compartment if a dew point inside the refrigerator compartment rises higher than or equal to a predetermined temperature.

The refrigerator according to an aspect of the present invention may further include a second cooler configured to cool the cooling plate, wherein the predetermined temperature may be lower than a lowermost temperature of the cooling plate. Here, the lowermost temperature of the cooling plate may also be referred to as a temperature of the cooling plate when the cooling of the cooling plate stops.

In the refrigerator according to an aspect of the present invention, the supply of the cooled air, subjected to heat exchange by the first cooler, to the refrigerator compartment may stop if the temperature of the refrigerator compartment falls below the predetermined temperature.

In the refrigerator according to an aspect of the present invention, the supply of the cooled air, subjected to heat exchange by the first cooler, to the refrigerator compartment may stop if the humidity of the refrigerator compartment falls below a predetermined humidity.

In the refrigerator according to an aspect of the present invention, the refrigerator compartment may include: a low-temperature room a temperature of which is set low; and a high-temperature room a temperature of which is set high, and the cooling plate may be provided in the low-temperature room.

In the refrigerator according to an aspect of the present invention, the low-temperature room may be provided with a temperature-humidity sensor.

The refrigerator according to an aspect of the present invention can reduce formation of condensation inside a refrigerator compartment while curbing a drop of humidity in the refrigerator compartment.

DETAILED DESCRIPTION OF THE INVENTION

Figure 1:
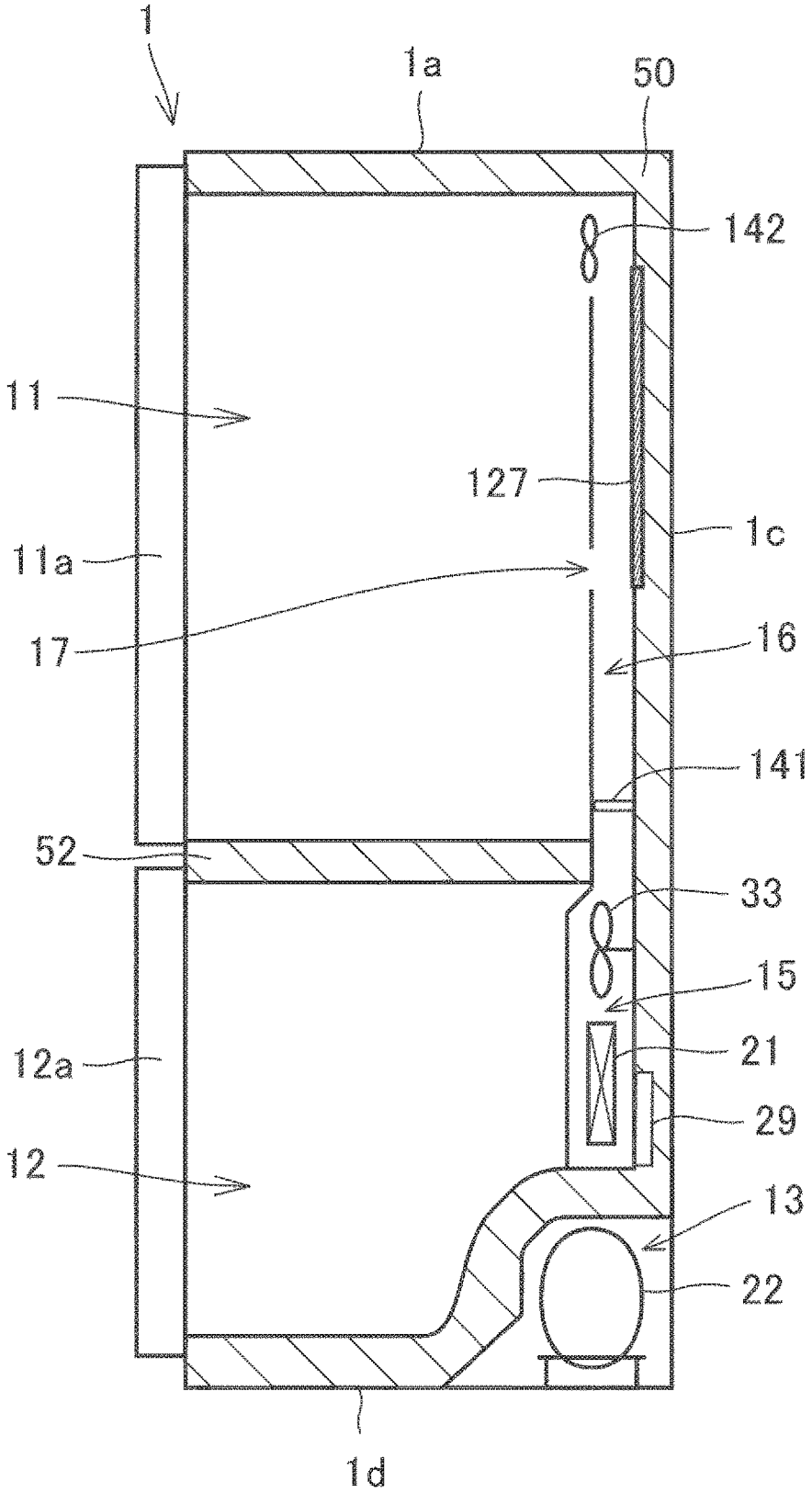
FIG. 1 is a cross-sectional view illustrating an internal configuration of a refrigerator according to an embodiment of the present invention.

Described below are the embodiments of the present invention, with reference to the drawings. In the detailed description that follows, identical constituent features have the same reference numerals. Such constituent features have the same name and function, and the details thereof will not be repeatedly elaborated upon.

First Embodiment

Overall Configuration of Refrigerator

Described first is an overall configuration of a refrigerator 1 according to this embodiment, with reference to FIG. 1. FIG. 1 illustrates an internal configuration of the refrigerator 1. The refrigerator 1 is provided with a thermal insulation box 50 acting as a thermal insulation structure to thermally insulate storage spaces from an environment around the refrigerator 1. The thermal insulation box 50 is provided to cover an outer periphery of the refrigerator 1. The thermal insulation box 50 includes therein the storage spaces such as a refrigerator compartment 11 and a freezer compartment 12. The refrigerator compartment 11 and the freezer compartment 12 are divided by a thermal insulation division wall 52.

In this embodiment, the refrigerator compartment 11 and the freezer compartment 12 are respectively arranged in an upper portion and a lower portion of the thermal insulation box 50. Note that the arrangement and the configurations of the storage spaces in the refrigerator according to the present invention shall not be limited to the above ones. The refrigerator compartment 11 may further be divided into two or more storage spaces by storage cases such as a vegetable case and a chilling case and by divider shelves.

As illustrated in FIG. 1, the refrigerator 1 is provided with open-close doors (a refrigerator compartment door 11*a* and a freezer compartment 12*a*, for example) in front of (in the left of FIG. 1) the storage spaces.

In this embodiment, a face to which a door is provided is referred to as the front face of the refrigerator. Then, with reference to the front face, the refrigerator 1 has such faces as a top face 1*a*, a side face, a back face 1*c*, and a bottom face 1*d* (see FIG. 1).

Configuration of Freezing Cycle

Figure 2:
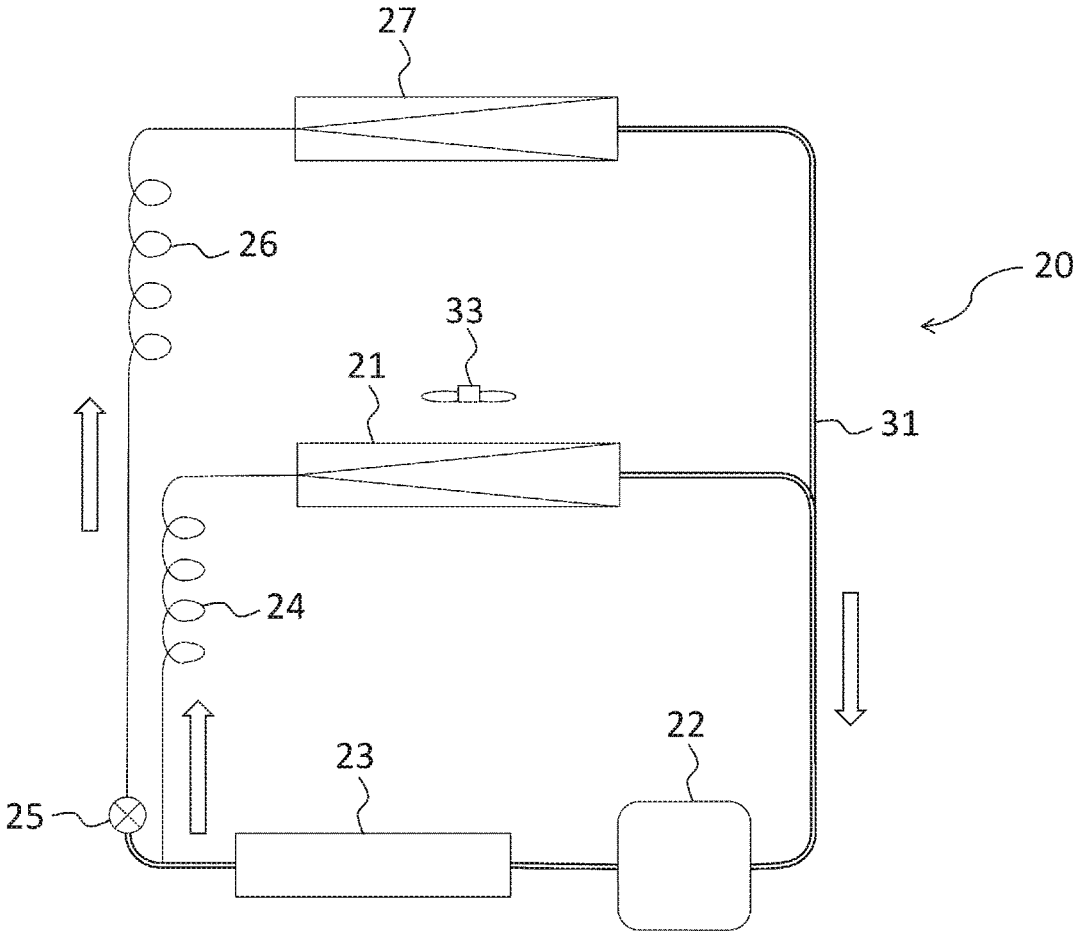
FIG. 2 is a schematic diagram illustrating a configuration of a freezing cycle provided in the refrigerator shown in FIG. 1.

The refrigerator 1 includes therein a freezing cycle 20. FIG. 2 illustrates a configuration of the freezing cycle 20. As main constituent features, the freezing cycle 20 includes: a freezer compartment evaporator (a first cooler) 21; a compressor 22; a condenser 23; a first capillary tube (an expander) 24; a valve 25; a second capillary tube (an expander) 26; and a refrigerator compartment evaporator (a second cooler) 27. These constituent features are connected to one another through a refrigerant pipe 31 conducting a refrigerant. Operating states (such as ON/OFF and open/close) of the constituent features in the freezing cycle 20 (such as the compressor 22 and the valve 25) are controlled by a controller 29 provided to an electrical unit in the refrigerator 1.

As illustrated in FIG. 2, the freezing cycle 20 has a first route including: the compressor 22; the condenser 23; the first capillary tube (expander) 24; and the freezer compartment evaporator (the first cooler) 21. Moreover, the freezing cycle 20 has a second route including: the compressor 22; the condenser 23; the valve 25; the second capillary tube (the expander) 26; and the refrigerator compartment evaporator (the second cooler) 27. The valve 25 is placed near a bifurcation of the first route and the second route. The valve 25 in this embodiment is a two-way valve. Alternatively, the valve 25 in other embodiments may be a three-way valve.

As illustrated in FIG. 1, the freezer compartment evaporator 21 is placed in a cooling room 15. The cooling room 15 is placed in back of the freezer compartment 12 and provided along the back face 1*c* of the refrigerator 1. The refrigerator compartment evaporator 27 is placed inside the refrigerator compartment 11. In an example, the refrigerator compartment evaporator 27 is a cooling plate 127 attached to a wall face (e.g., a back face) of the refrigerator compartment 11. The compressor 22 is placed inside a machine room 13 on the bottom of, and in the back of, the refrigerator 1.

The cooling room 15 includes therein such components as a cooling fan 33, other than the freezer compartment evaporator 21. The cooling fan 33 is provided to circulate air between the cooling room 15 and the storage spaces. That is, operating in conjunction with the operation of the compressor 22, the cooling fan 33 (i) sends, through flow passages to the storage spaces, the cooled air generated by heat exchange with the freezer compartment evaporator 21, and (ii) brings the cooled air supplied to the storage spaces back to the cooling room 15.

When the compressor 22 is driven, the freezing cycle 20 starts operating and the refrigerant flows in the direction indicated by arrows in FIG. 2. During the operation of the freezing cycle 20, the refrigerant always flows through the first route. Meanwhile, the refrigerant flows through the second route when the valve 25 opens.

Compressed by the compressor 22, the refrigerant has a high temperature and pressure. Releasing heat, the refrigerant is compressed in the condenser 23, and then liquefied. The liquefied refrigerant passes through the first capillary tube 24 acting as an expander. After that, the refrigerant is sent to the freezer compartment evaporator 21 to expand to have a low temperature and pressure. The refrigerant flowing into the freezer compartment evaporator 21 exchanges heat with the air flowing through the cooling room 15. Absorbing the heat and evaporating, the refrigerant becomes a gaseous refrigerant at a low temperature. Hence, the air inside the cooling room 15 is cooled to be the cooled air. The gaseous refrigerant; that is, the vaporized refrigerant in the freezer compartment evaporator 21, is sent to the compressor 22.

Moreover, when the valve 25 is open, the liquefied refrigerant is also sent to another expander; that is, the second capillary tube 26. The liquefied refrigerant passes through the second capillary tube 26. After that, the refrigerant is sent to the refrigerator compartment evaporator 27 to expand to have a low temperature and pressure. The refrigerant passing through the refrigerator compartment evaporator 27 expands to be vaporized. Here, the refrigerant absorbs heat from the surroundings such that the air inside the refrigerator compartment 11 provided with the refrigerator compartment evaporator 27 is cooled. The gaseous refrigerant; that is, the vaporized refrigerant in the refrigerator compartment evaporator 27, is sent to the compressor 22.

In the second route of the freezing cycle 20, the valve 25 is opened and closed to control the circulation of the refrigerant. Hence, the opening and closing of the valve 25 is controlled based on a result of detecting the temperature inside the refrigerator compartment 11, so that the temperature inside the refrigerator compartment 11 is adjusted to reach a desired temperature.

How to Cool Storage Spaces

Described next is how to cool the refrigerator compartment 11 and the freezer compartment 12.

The refrigerator compartment 11 is cooled by the refrigerator compartment evaporator 27 provided in the second route of the freezing cycle 20. Specifically, the refrigerator compartment 11 is cooled by the cooling plate 127 placed on the back face of the refrigerator compartment 11. Note that a refrigerator compartment fan 142 is provided inside the refrigerator compartment 11 to stir the inside air. Moreover, a return opening 17 is provided inside the refrigerator compartment 11 to bring the inside air back to the cooling plate 127. Hence, the air cooled near the cooling plate 127 circulates inside the refrigerator compartment 11. In an example, the refrigerator compartment 11 is designed so that the inside thereof reaches a temperature of approximately 4° C. when the temperature inside the refrigerator compartment 11 is stable while the cooling plate 127 has a temperature of −1° C. and the refrigerator compartment fan 142 is rotating. Hence, the cooling plate 127 is provided inside, and cools, the storage space. Such a technique is referred to as the direct-cooling.

In addition to the cooling using the cooling plate 127, the refrigerator compartment 11 is also cooled with the cooled air generated by the freezer compartment evaporator 21. That is, the back face of the refrigerator compartment 11 is provided with a cooled air delivery passage 16 communicating with the cooling room 15. Between the refrigerator compartment 15 and the cooled air delivery passage 16, a refrigerator compartment delivery damper 141 is provided. If the temperature and the humidity inside the refrigerator compartment 11 satisfy a predetermined condition, for example, the refrigerator compartment delivery damper 141 is open so that the cooled air subjected to heat exchange by the freezer compartment evaporator 21 passes through the cooled air delivery passage 16 and flows it to the refrigerator compartment 11.

Hence, the cooled air, subjected to heat exchange by the freezer compartment evaporator 21, is delivered into, and cools, the storage space. Such a technique is referred to as the indirect-cooling.

The freezer compartment 12 is cooled only with the cooled air generated by the freezer compartment evaporator 21. That the freezer compartment 12 communicates with the cooling room 15. The cooled air subjected to heat exchange by the freezer compartment evaporator 21 is blown inside the freezer compartment 12, using the cooling fan 33, and the freezer compartment 12 is cooled.

As can be seen, in the refrigerator 1 according to this embodiment, the refrigerator compartment 11 is cooled by both the direct-cooling and the indirect-cooling. Note that the refrigerator compartment 11 is cooled mainly by the direct-cooling, and the indirect-cooling is used as necessary. The controller 29 controls the operation of the compressor 22, the opening and closing of the valve 25, and the opening and closing of the refrigerator compartment delivery damper 141, based on, for example, conditions of a temperature and a humidity inside the refrigerator compartment 11 and the freezer compartment 12.

In an example, based on a result of detecting a temperature of the freezer compartment 12, the controller 29 controls ON/OFF of the compressor 22 in the freezing cycle 20. For example, the controller 29 turns the compressor 22 ON when the temperature of the freezer compartment 12 rises higher than or equal to a predetermined value (e.g., −16° C.). Moreover, the controller 29 turns the compressor 22 OFF when the temperature of the freezer compartment 12 falls lower than or equal to a predetermined value (e.g., −22° C.). When the compressor 22 is ON, the refrigerant circulates in the freezing cycle 20 (at least in the first route).

Moreover, while the compressor 22 is running, the controller 29 controls the opening and closing of the valve 25 based on a result of detecting a temperature of the cooling plate 127 (alternatively, a temperature of the refrigerator compartment 11). For example, the controller 29 opens the valve 25 when the temperature of the cooling plate 127 rises higher than or equal to a predetermined value (e.g., 3° C.). Moreover, the controller 29 closes the valve 25 when the temperature of the cooling plate 127 falls lower than or equal to a predetermined value (e.g., −1° C.). When the valve 25 is open, the refrigerant circulates in the second route of the freezing cycle 20, and the cooling plate 127 is cooled.

Furthermore, the controller 29 controls the opening and closing of the refrigerator compartment delivery damper 141, based on a result of detecting a temperature and a humidity inside the refrigerator compartment 11. For example, the controller 29 opens the refrigerator compartment delivery damper 141 when the humidity inside the refrigerator compartment 11 rises higher than or equal to a predetermined value. Moreover, the controller 29 closes the refrigerator compartment delivery damper 141 when the temperature or the humidity inside the refrigerator compartment 11 falls below the predetermined value. When the refrigerator compartment delivery damper 141 is open, the cooled air colder and less humid flows from the cooling room 15 into the refrigerator compartment 11. Such features make it possible to decrease the temperature inside the refrigerator compartment 11 in a short period of time, and also decrease the humidity inside the refrigerator compartment 11. Note that the level of the humidity inside the refrigerator compartment 11 may be determined based on a dew point inside the refrigerator compartment 11. The dew point under a predetermined condition can be unambiguously calculated from a humidity and a temperature under the predetermined condition.

How to Control Temperature and Humidity of Refrigerator Compartment

Figure 3:
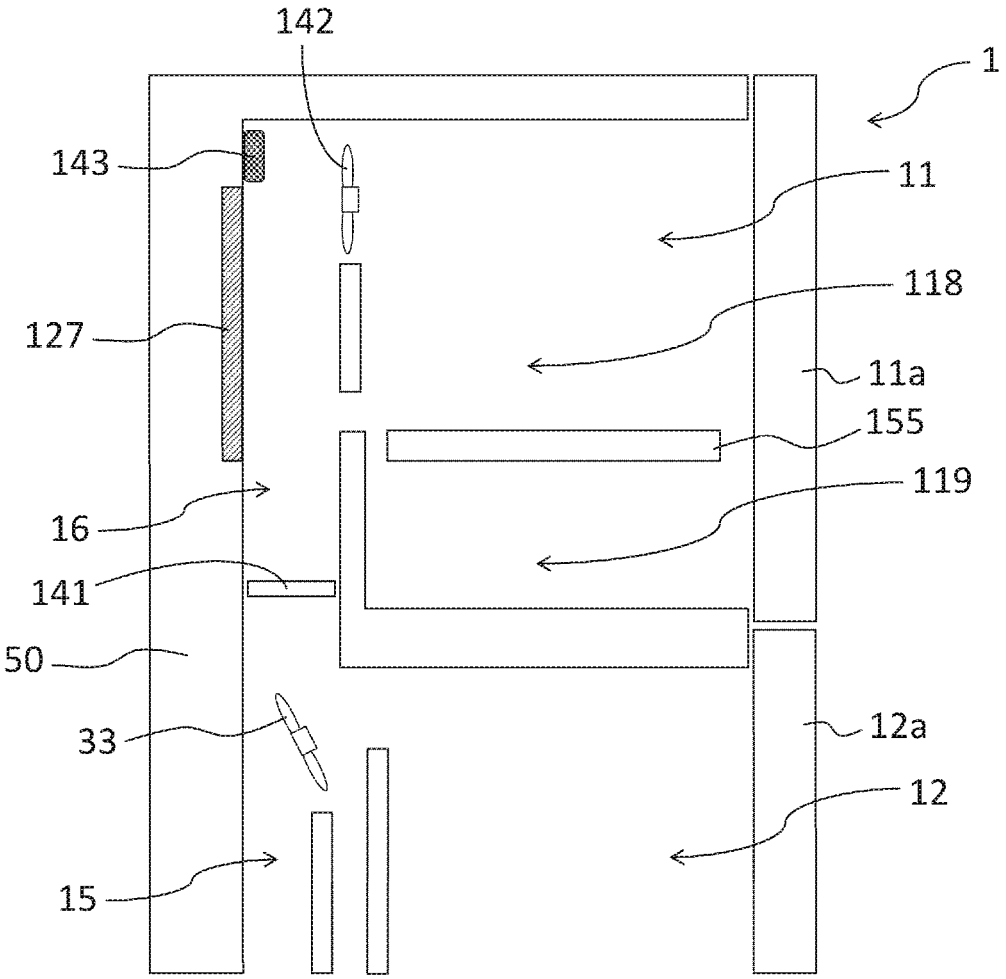
FIG. 3 is a cross-sectional view illustrating a configuration of surroundings of a refrigerator compartment in the refrigerator according to a first embodiment.
Figure 4:
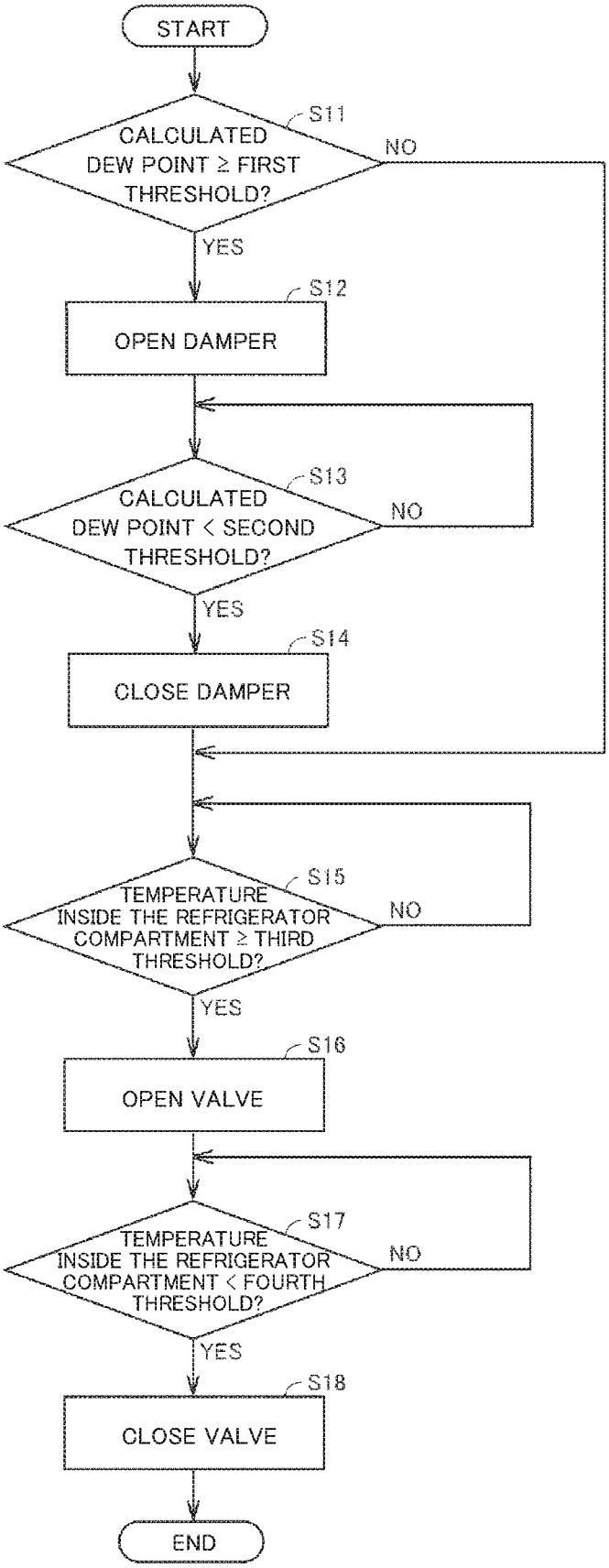
FIG. 4 is a flowchart showing a flow of processing to control temperature and humidity inside the refrigerator compartment of the refrigerator according to the first embodiment.

Described next is how to control the temperature and the humidity of the refrigerator compartment 11. FIG. 3 illustrates a more specific configuration of the inside of the refrigerator compartment 11 of the refrigerator 1. Furthermore, FIG. 4 illustrates an example of how to control the temperature and the humidity inside the refrigerator compartment 11.

As illustrated in FIG. 3, the inside of the refrigerator compartment 11 according to the first embodiment is divided by a divider shelf 155 into two spaces; namely, an upper space 118 and a lower space 119. For example, the upper space 118 can be used as a typical refrigerator compartment, and the lower space 119 can be used for such compartments as a chilling compartment and a vegetable compartment.

The cooling plate 127 included in the second route of the freezing cycle 20 is placed on the wall face n back of the cooled air delivery passage 16 provided in the back of the refrigerator compartment 11. The refrigerator compartment fan 142 is placed in an upper portion the refrigerator compartment 11 and between the cooled air delivery passage 16 and the upper space 118. The operation of the refrigerator compartment fan 142 is controlled based on, for example, a condition of temperature inside the refrigerator compartment 11. The arrangement of the cooling plate 127 and the refrigerator compartment fan 142 is not limited to such an arrangement.

Positioned near the cooling plate 127 (above the cooling plate 127 in the example s ted FIG. 3) is a temperature-humidity sensor 143. The position of the temperature-humidity sensor 143 is not limited to such a position. The temperature-humidity sensor 143 detects a temperature and a humidity near the cooling plate 127. Note that, in this embodiment, the temperature and the humidity detected by the temperature-humidity sensor 143 are interpreted to be the temperature and the humidity inside the refrigerator compartment 11.

A dew point inside the refrigerator compartment 11 is calculated, by a conventionally known technique, from the temperature and the humidity (relative humidity) measured by the temperature-humidity sensor 143. Note that, in other embodiments, a temperature sensor and a dew point sensor can be used instead of the temperature-humidity sensor 143.

In this embodiment, based on the temperature of the refrigerator compartment 11 measured by the temperature-humidity sensor 143 and the dew point calculated from the temperature and the humidity measured by the temperature-humidity sensor 143, the opening and closing of the valve 25 in the freezing cycle 20 and the opening and closing of the refrigerator compartment delivery damper 141 are controlled.

A specific control technique is described with reference to FIG. 4. In an exemplary explanation in FIG. 4, the refrigerator compartment delivery damper 141 is initially closed, and the valve 25 is initially closed.

First, the controller 29 determines whether a calculated dew point is higher than or equal to a predetermined temperature (a first threshold) (Step S11). If the dew point is lower than the first threshold (NO in Step S11), the refrigerator compartment delivery damper 141 is kept closed, and the processing proceeds to Step S15.

Meanwhile, if the dew point is higher than or equal to the first threshold (YES in Step S11), the refrigerator compartment delivery damper 141 is open (Step S12). When the refrigerator compartment delivery damper 141 is open, colder cooled air (e.g., approximately −20 to −15° C.) generated in the cooling room 15 flows through the cooled air delivery passage 16 into the refrigerator compartment 11. Hence, the temperature inside the refrigerator compartment 11 quickly falls.

Note that the low-temperature cooled air generated inside the cooling room 15 is low in water content, and drier than the air inside the refrigerator compartment 11. That is, the cooled air generated inside the cooling room 15 is lower in humidity. Hence, when the refrigerator compartment delivery damper 141 is opened, the humidity inside the refrigerator compartment 11 decreases. Accordingly, the dew point decreases, too.

The controller 29 calculates the dew point inside the refrigerator compartment 11 from the temperature and the humidity measured by the temperature-humidity sensor 143 at all times or at regular time intervals. Then, the controller 29 determines whether the calculated dew point falls below a predetermined temperature (a second threshold) (Step S13). If the dew point is higher than or equal to the second threshold (NO in Step S13), the refrigerator compartment delivery damper 141 is kept open.

After that, if the dew point calculated from the temperature and the humidity measured by the temperature-humidity sensor 143 falls below the second threshold (YES in Step S13), the controller 29 turns the refrigerator compartment delivery damper 141 from open to closed (Step S14).

Then, the processing proceeds to Step S15. In the processing subsequent to Step S15, the controller 29 controls the opening and closing of the valve 25, based on the temperature, inside the refrigerator compartment 11, measured by the temperature-humidity sensor 143.

In Step S15, the controller 29 determines whether the temperature inside the refrigerator compartment 11 is higher than or equal to a predetermined temperature (a third threshold) (Step S15). If the temperature inside the refrigerator compartment 11 is lower than the third threshold (NO in Step S15), the valve 25 is kept closed. Then, the controller 29 repeats the processing in Step S15.

Then, if the temperature inside the refrigerator compartment 11 rises higher than or equal to the third threshold, (YES in Step S15), the controller 29 turns the valve 25 from closed to open (Step S16). Hence, the refrigerant in the freezing cycle 20 circulates also in the second route, and the cooling plate 127 is cooled. As a result, the temperature inside the refrigerator compartment 11 gradually falls.

The controller 29 continues to monitor the temperature inside the refrigerator compartment 11, and determines whether the temperature inside the refrigerator compartment 11 falls below a predetermined temperature (a fourth threshold) (Step S17). If the temperature inside the refrigerator compartment 11 is higher than or equal to the fourth threshold (NO in Step S17), the valve 25 is kept open. Then, the controller 29 repeats the processing in Step S17.

After that, if the temperature inside the refrigerator compartment 11 falls below the fourth threshold, (YES in Step S17), the controller 29 turns the valve 25 from open to closed (Step S18). The closed valve 25 stops the supply of the refrigerant to the second route in the freezing cycle 20. Hence, the decrease in the temperature of the cooling plate 127 stops, and then, the temperature of the cooling plate 127 starts rising.

As can be seen, the controller 29 controls the opening and closing of the valve 25 in the freezing cycle 20, and the opening and closing of the refrigerator compartment delivery damper 141, thereby maintaining the temperature and the humidity inside the refrigerator compartment 11 in an appropriate condition.

In the above processing, the first threshold of the dew point is also referred to as a damper opening dew point. The damper opening dew point may be set to 1° C., for example. Moreover, the second threshold of the dew point is also referred to as a damper closing dew point. The damper closing dew point may be set to −1° C., for example.

Furthermore, the third threshold of the temperature inside the refrigerator compartment is also referred to as a valve opening temperature. The valve opening temperature may be set to 3° C., for example. In addition, the fourth threshold of the temperature inside the refrigerator compartment is also referred to as a valve closing temperature. The valve closing temperature may be set to −1° C., for example.

Application to Vegetable Compartment

If the lower space 119 of the refrigerator compartment 11 is a vegetable compartment, described next is how to maintain the temperature and humidity inside the vegetable compartment in an appropriate condition, using the above control technique.

Desirably, vegetable are preserved under an environment at a relatively high humidity and at a low temperature which is not excessively low to keep from freezing. Moreover, it is known that leafy vegetables such as spinach and *komatsuna* (i.e., Japanese mustard spinach) stay fresh longer as the temperature is lower. Note that, however, if the vegetables get frozen or wet, the frozen or wet portion starts to go bad. Hence, the vegetables may be preserved in an environment which keeps them from freezing and condensation.

Thus, in the refrigerator compartment 11, for example, the temperatures of the upper space 118 and the lower space 119 (i.e., the vegetable compartment) are respectively set to 4° C. and 0.5° C. Moreover, in order to maintain the humidity of the vegetable compartment in an appropriate condition, the above control technique is used to maintain the dew point inside the refrigerator compartment 11 within a desired temperature range.

Table 1 below shows relationships between humidities, temperatures, and dew points.

TABLE 1

| Humidity | Temperature | | | | | | | | |
|---|---|---|---|---|---|---|---|---|---|
| | 0.0 | 0.5 | 1.0 | 1.5 | 2.0 | 2.5 | 3.0 | 3.5 | 4.0 |
| 9% | −27.8 | −27.5 | −27.1 | −26.8 | −26.4 | −26.1 | −25.7 | −25.4 | −25.0 |
| 70% | −4.8 | −4.3 | −3.9 | −3.4 | −2.9 | −2.4 | −2.0 | −1.5 | −1.0 |
| 72% | −4.4 | −3.9 | −3.4 | −2.9 | −2.4 | −2.0 | −1.5 | −1.0 | −0.5 |
| 75% | −3.9 | −3.4 | −2.9 | −2.4 | −2.0 | −1.5 | −1.0 | −0.5 | 0.0 |
| 78% | −3.4 | −2.9 | −2.5 | −2.0 | −1.5 | −1.0 | −0.5 | 0.0 | 0.5 |
| 80% | −2.9 | −2.5 | −2.0 | −1.5 | −1.0 | −0.5 | 0.0 | 0.5 | 0.9 |
| 83% | −2.5 | −2.0 | −1.5 | −1.0 | −0.5 | 0.0 | 0.5 | 1.0 | 1.4 |
| 86% | −2.0 | −1.5 | −1.0 | −0.5 | 0.0 | 0.5 | 1.0 | 1.5 | 1.9 |
| 90% | −1.5 | −1.0 | −0.5 | 0.0 | 0.5 | 1.0 | 1.5 | 2.0 | 2.4 |
| 93% | −1.0 | −0.5 | 0.0 | 0.5 | 1.0 | 1.5 | 2.0 | 2.5 | 3.0 |
| 96% | −0.5 | 0.0 | 0.5 | 1.0 | 1.5 | 2.0 | 2.5 | 3.0 | 3.5 |
| 100% | 0.0 | 0.5 | 1.0 | 1.5 | 2.0 | 2.5 | 3.0 | 3.5 | 4.0 |

In the above example, if the dew point is controlled to be set to −1° C. when the vegetable compartment has a set temperature of 0.5° C., the vegetable compartment (the lower space 119) has a humidity of 90%, making it possible to provide a condensation-free storage space at high humidity. Hence, in the above control technique, the damper opening dew point and the damper closing dew point are set so that a target value of the dew point in the refrigerator compartment 11 is −1° C. Hence, the temperature and the humidity of the vegetable compartment (the lower space 119) can be maintained in an appropriate condition.

Summary of First Embodiment

As can be seen, the refrigerator 1 according to this embodiment includes: the freezer compartment evaporator (the first cooler) 21; the refrigerator compartment 11; and the freezer compartment 12. The refrigerator compartment 11 is cooled by direct-cooling, using the cooling plate 127. The inside of the freezer compartment 12 is cooled by circulation of the cooled air subjected to heat exchange by the freezer compartment evaporator 21. Moreover, the refrigerator 1 sends the refrigerator compartment 11 the cooled air subjected to heat exchange by the freezer compartment evaporator 21. Specifically, when the refrigerator compartment delivery damper 141 is open, the cooled air inside the cooling room 15 can be sent from the cooled air delivery passage 16 into the refrigerator compartment 11; that is the refrigerator compartment 11 can be cooled by the indirect-cooling.

Because of this configuration, the refrigerator compartment 11 is cooled by the direct-cooling, so that the humidity inside the refrigerator compartment 11 can be maintained high. Moreover, if the refrigerator compartment 11 is to be quickly cooled, the refrigerator compartment delivery damper 141 is opened to send from the cooling room 15 the cooled air at lower temperature. Hence, the refrigerator compartment 11 can be quickly cooled.

Furthermore, the refrigerator 1 according to this embodiment executes the following control: if the dew point rises higher than or equal to a predetermined temperature (the first threshold), the refrigerator compartment delivery damper 141 is opened, and if the dew point falls below a predetermined temperature (the second threshold), the refrigerator compartment delivery damper 141 is closed. This control can reduce the risk that the humidity inside the refrigerator compartment 11 rises excessively high while the temperature inside the refrigerator compartment 11 is relatively high. Such a feature makes it possible to reduce formation of condensation inside the refrigerator compartment 11. Note that the temperature of the cooling plate 127 is maintained above the dew point, making it possible to further reduce formation of condensation on the cooling plate 127.

Note that, in the above embodiment, the refrigerator compartment delivery damper 141 is opened and closed to control flow of the cooled air inside the cooling room 15 into the refrigerator compartment 11. Alternatively, in other embodiments, an air volume of the fan, instead of the damper, may be adjusted to control the cooled air to be sent to the refrigerator compartment.

Second Embodiment

Described next is a second embodiment of the present invention. The second embodiment is different in position of a temperature-humidity sensor from the first embodiment. Otherwise, configurations similar to those in the first embodiment may be applicable. Hence, the second embodiment mainly describes configurations different from those in the first embodiment.

Figure 5:
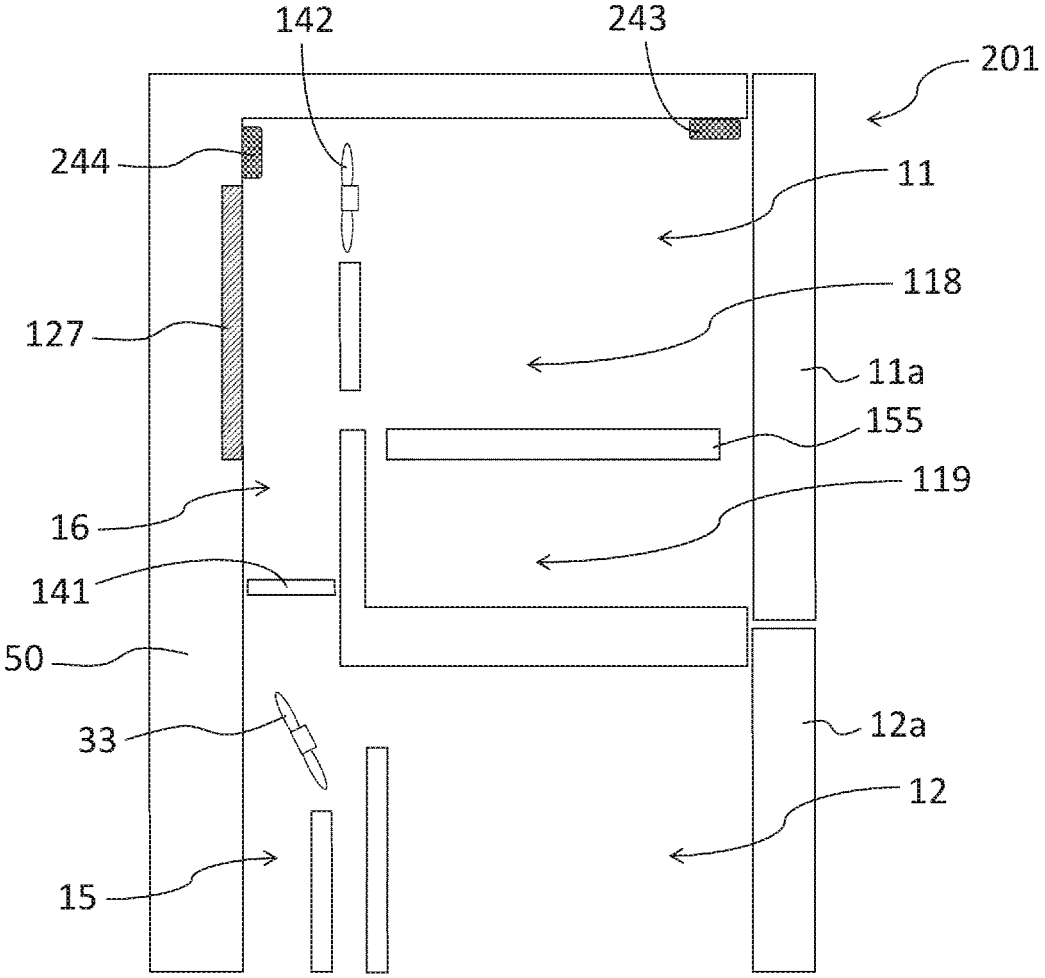
FIG. 5 is a cross-sectional view illustrating a configuration of surroundings of a refrigerator compartment in a refrigerator according to a second embodiment.

FIG. 5 illustrates an internal configuration of a refrigerator 201 according to the second embodiment. The inside of the refrigerator compartment 11 is divided by the divider shelf 155 into two spaces; namely, the upper space 118 and the lower space 119. The cooled air delivery passage 16 is provided in the back of the refrigerator compartment 11, The cooling plate 127 is provided on the wall face in back of the cooled air delivery passage 16. Between the cooled air delivery passage 16 and the upper space 118, the refrigerator compartment fan 142 is provided. These configurations are the same as those in the first embodiment.

The refrigerator compartment 11 includes therein a temperature-humidity sensor 243 and a cooling plate temperature sensor 244. In the first embodiment, the temperature-humidity sensor 143 is placed near the cooling plate 127. In contrast, the temperature-humidity sensor 243 in this embodiment is placed on a top face of the refrigerator compartment near the refrigerator compartment door 11*a* near an access opening of the refrigerator compartment 11). Furthermore, in this embodiment, the cooling plate temperature sensor 244, which is another temperature sensor, is placed near the cooling plate 127. Note that in another embodiment, a sensor placed near the cooling plate 127 may be a temperature-humidity sensor, and a sensor placed near the refrigerator compartment door 11*a* may be a temperature sensor.

A temperature and a humidity inside the refrigerator compartment 11 detected by the temperature-humidity sensor 243 is mainly used for controlling opening and closing of the refrigerator compartment delivery damper 141. Moreover, a temperature of the cooling plate 127 detected by the cooling plate temperature sensor 244 is mainly used for controlling opening and closing of the valve 25.

Figure 6:
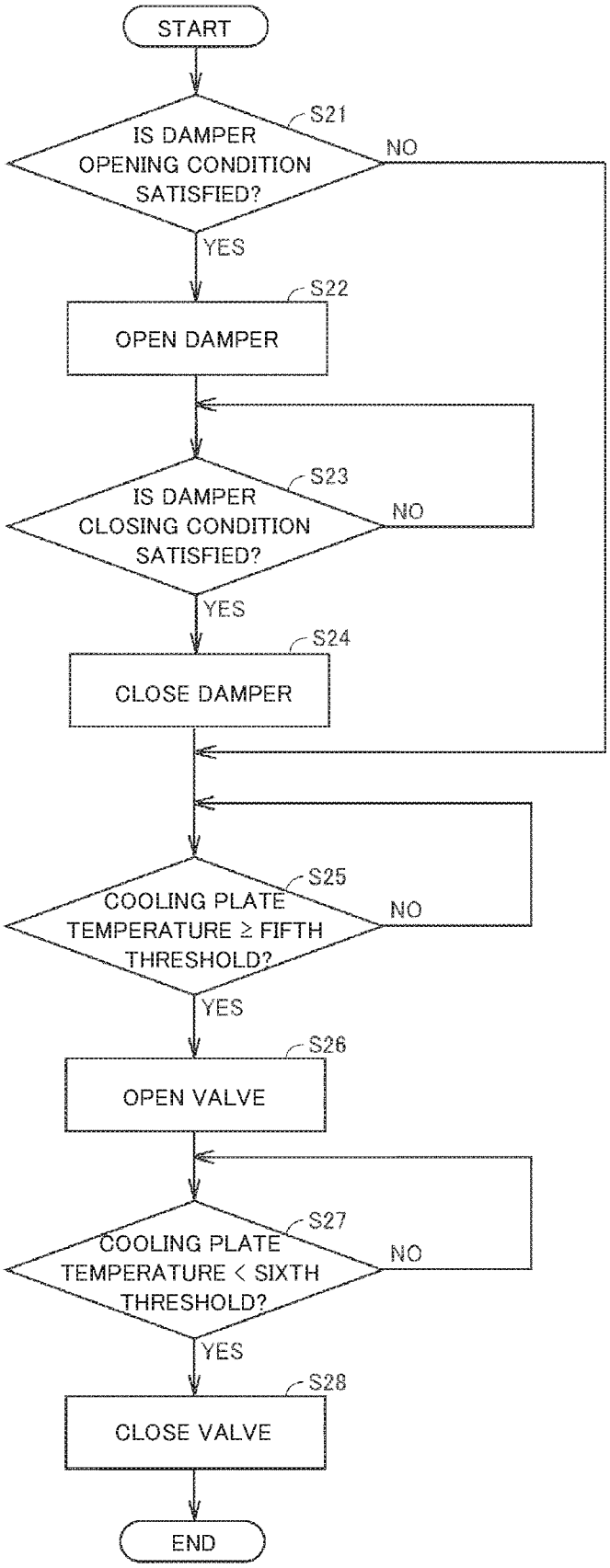
FIG. 6 is a flowchart showing a flow of processing to control temperature and humidity inside the refrigerator compartment of the refrigerator according to the second embodiment.

Described below is an example of how to control the temperature and the humidity of the refrigerator compartment 11 with reference to FIG. 6. Moreover, FIG. 6 shows an example of how to control the temperature and the humidity inside the refrigerator compartment 11. In the exemplary explanation in FIG. 6, the refrigerator compartment delivery damper 141 is initially closed and the valve 25 is initially closed.

First, the controller 29 determines whether a condition to open the refrigerator compartment delivery damper 141 (a damper opening condition) is satisfied (Step S21). Here, the damper opening condition is satisfied if either condition; namely a condition (A) or a condition (B), is satisfied (an OR condition).

(A) The dew point calculated from the temperature and the humidity detected by the temperature-humidity sensor 243 is higher than or equal to a predetermined temperature (a first threshold); that is, the dew point≥the first threshold.

(B) The temperature detected by the temperature-humidity sensor 243 is higher than or equal to a predetermined temperature (a second threshold); that is, the temperature inside the refrigerator compartment≥the second threshold.

Note that, in order to keep the inside of the refrigerator compartment 11 from excessively cooling, the damper opening condition may include a precondition; that is, if the temperature inside the refrigerator compartment is lower than a predetermined temperature, the refrigerator compartment delivery damper 141 is not opened.

In Step S21, if the damper opening condition is not satisfied (NO in Step S21), the refrigerator compartment delivery damper 141 is kept closed. The processing proceeds to Step S25.

Meanwhile, if the damper opening condition is satisfied (YES in Step S21), the refrigerator compartment delivery damper 141 is opened (Step S22). When the refrigerator compartment delivery damper 141 is opened, the cooled air generated inside the cooling room 15 flows through the cooled air delivery passage 16 into the refrigerator compartment 11. Hence, the temperature inside the refrigerator compartment 11 quickly falls.

Note that the cooled air generated inside the cooling room 15 is low in water content, and drier than the air inside the refrigerator compartment 11. That is, the cooled air ted inside the cooling room 15 is lower in humidity. Hence, when the refrigerator compartment delivery damper 141 is opened, the humidity inside the refrigerator compartment 11 decreases. Accordingly the dew point decreases, too.

The controller 29 calculates the dew point inside the refrigerator compartment 11 from the temperature and the humidity measured by the temperature-humidity sensor 243 at all times or at regular time intervals. Then, the controller 29 determines whether a condition to close the refrigerator compartment delivery damper 141 (a damper closing condition) is satisfied (Step S23). Here, the damper closing condition is satisfied if both of the conditions; namely a condition (C) and a condition (D), are satisfied (an AND condition).

(C) The dew point calculated from the temperature and the humidity detected by the temperature-humidity sensor 243 is lower than a predetermined temperature (a third threshold); that is, the dew point<the first threshold.

(D) The temperature detected by the temperature-humidity sensor 243 is lower than a predetermined temperature (a fourth threshold); that is, the temperature inside the refrigerator compartment<the fourth threshold.

Note that, in order to keep the inside of the refrigerator compartment 11 from excessively cooling, the damper closing condition may include a precondition; that is, if the temperature inside the refrigerator compartment is lower than a predetermined temperature, the refrigerator compartment delivery damper 141 is closed Moreover, in another embodiment, the damper closing condition may be satisfied if either the condition (C) or the condition (D) is satisfied (an OR condition).

In Step S23, if the damper closing condition is not satisfied (NO in Step S23), the refrigerator compartment delivery damper 141 is kept open.

After that, if the damper closing condition is satisfied (YES in Step S23), the controller 29 turns the refrigerator compartment delivery damper 141 from open to closed (Step S24).

Then, the processing proceeds to Step S25. In the processing subsequent to Step S25, the controller 29 controls the opening and closing of the valve 25, based on the temperature measured by the temperature-humidity sensor 244.

In Step S25, the controller 29 determines whether the temperature of the cooling plate 127 is higher than or equal to a predetermined temperature (a fifth threshold) (Step S25). If the temperature of the cooling plate 127 is lower than the fifth threshold (NO in Step S25), the valve 25 is kept closed. Then, the controller 29 repeats the processing in Step S25.

Then, if the temperature inside the refrigerator compartment 11 rises higher than or equal to the fifth threshold, (YES in Step S25), the controller 29 turns the valve 25 from closed to open (Step S26). Hence, the refrigerant in the freezing cycle 20 circulates also in the second route, and the cooling plate 127 is cooled. As a result, the temperature inside the refrigerator compartment 11 gradually falls.

The controller 29 continues to monitor the temperature inside the refrigerator compartment 11, and determines whether the temperature inside the refrigerator compartment 11 falls below a predetermined temperature (a sixth threshold) (Step S27). If the temperature inside the refrigerator compartment 11 is higher than or equal to the sixth threshold (NO in Step S27), the valve 25 is kept open. Then, the controller 29 repeats the processing in Step S27.

After that, if the temperature inside the refrigerator compartment 11 falls below the sixth threshold, (YES in Step S27), the controller 29 turns the valve 25 from open to closed (Step S28). The closed valve 25 stops the supply of the refrigerant to the second route in the freezing cycle 20.

Hence, the decrease in the temperature of the cooling plate 127 stops, and then, the temperature of the cooling plate 127 starts rising.

As can be seen, the controller 29 controls the opening and closing of the valve 25 in the freezing cycle 20 and of the refrigerator compartment delivery damper 141, thereby maintaining the temperature and the humidity inside the refrigerator compartment 11 in an appropriate condition.

In the above processing, the first threshold of the dew point is also referred to as a damper opening dew point. The damper opening dew point may be set to 1° C., for example. Moreover, the second threshold of the temperature inside the refrigerator compartment is also referred to as a damper opening refrigerator compartment temperature. The damper opening refrigerator compartment temperature may be set to 7° C., for example. Furthermore, the third threshold of the dew point is also referred to as a damper closing dew point. The damper closing dew point may be set to −1° C., for example. In addition, the fourth threshold of the temperature inside the refrigerator compartment is also referred to as a damper closing refrigerator compartment temperature. The damper closing refrigerator compartment temperature may be set to 1° C., for example. In addition, the fifth threshold of the temperature of the cooling plate is also referred to as a valve opening temperature. The valve opening temperature may be set to 3° C., for example. Furthermore, the sixth threshold of the temperature of the cooling plate is also referred to as a valve closing temperature. The valve closing temperature may be set to −1° C., for example.

As can be seen, the temperature-humidity sensor 243 in this embodiment is placed on the top face of the refrigerator compartment near the refrigerator compartment door 11*a* near the access opening of the refrigerator compartment 11). Near the access opening of the refrigerator compartment 11, the temperature-humidity sensor 243 is susceptible to the outside air because of the opening and closing of the refrigerator compartment door 11*a*. Hence, the temperature detected by the temperature-humidity sensor 243 is likely to rise higher than the temperature detected near the cooling plate 127.

If the refrigerator compartment door 11*a* is frequently opened and closed, and a warm meal is put in the refrigerator compartment 11, the temperature might differ between the refrigerator compartment 11 and the cooling plate 127. In such a case, as shown in this embodiment, the opening and closing of the refrigerator compartment delivery damper 141 is controlled based on the temperature and the humidity measured by the temperature-humidity sensor 243 provided near the refrigerator compartment door 11*a*, making it possible to cool the refrigerator compartment more quickly.

Third Embodiment

Described next is a third embodiment of the present invention. The third embodiment is different in arrangement of a cooling plate and a temperature-humidity sensor from the first embodiment. Otherwise, configurations similar to those in the first embodiment may be applicable. Hence, the third embodiment mainly describes configurations different from those in the first embodiment.

Figure 7:
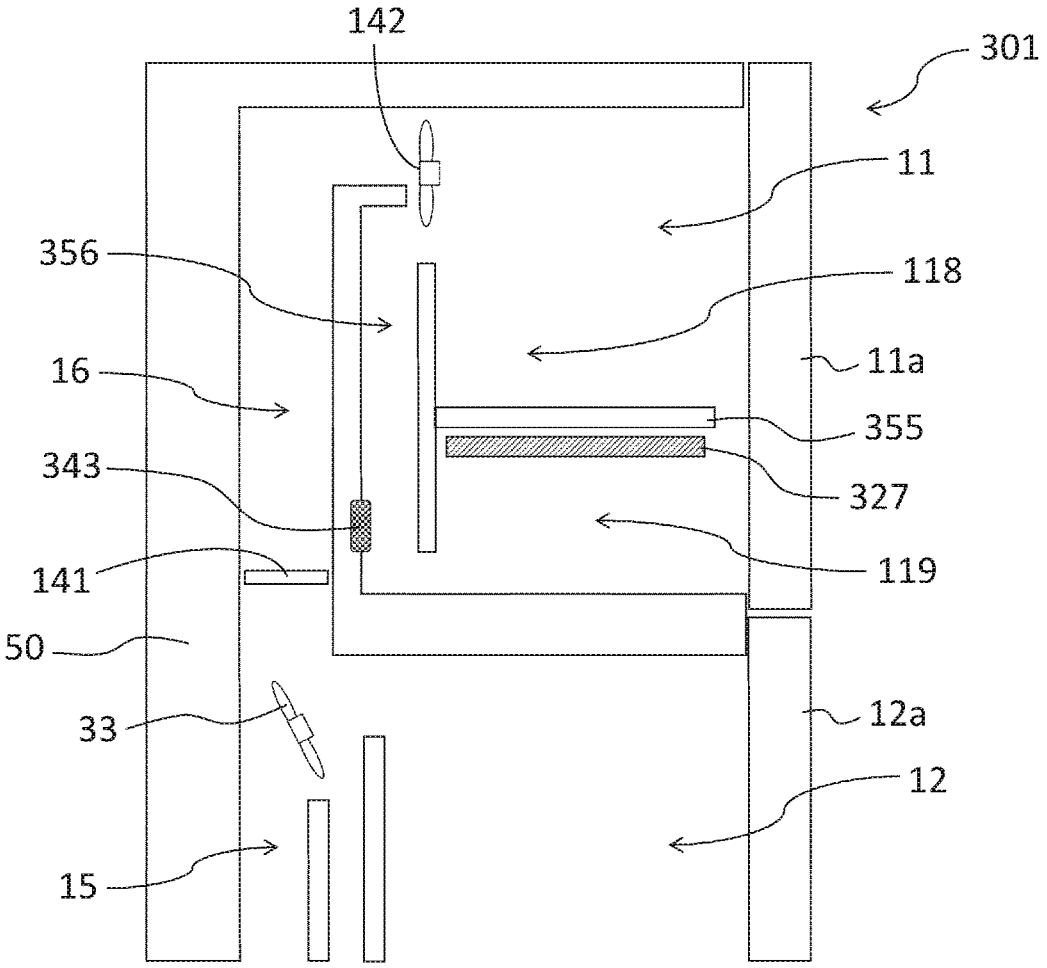
FIG. 7 is a cross-sectional view illustrating a configuration of surroundings of a refrigerator compartment in a refrigerator according to a third embodiment.

FIG. 7 illustrates an internal configuration of a refrigerator 301 according to the third embodiment. The inside of the refrigerator compartment 11 is divided by a divider shelf 355 into two spaces; namely, the upper space 118 and the lower space 119. The cooled air delivery passage 16 is provided in the back of the refrigerator compartment 11. As to these features, configurations substantially similar to those in the first embodiment may be applicable.

In this embodiment, the position of the cooling plate 327 is different from that of the cooling plate 127 in the first embodiment. In this embodiment, the cooling plate 327 is provided in the lower space 119. The temperature set in the lower space 119 is lower than the temperature set in the upper space 118. The lower space 119 and the upper space 118 are also respectively referred to as a low-temperature room and a high-temperature room. Since the cooling plate 327 is provided in the low-temperature room whose temperature is set lower, the low-temperature room can be preferentially cooled.

The lower space 119 can be used for a vegetable compartment and a chilling compartment, for example. Moreover, the lower space 119 can be maintained in a condition at a relatively high humidity and at a low-temperature which is not excessively low to keep from freezing. Hence, the lower space 119 can be beneficially used as a vegetable compartment.

Furthermore, as illustrated in FIG. 7, a refrigerator compartment interior circulation route 356 is formed in back of the divider shelf 355. Then, provided above the refrigerator compartment interior circulation route 356 is the refrigerator compartment fan 142. When the refrigerator compartment fan 142 rotates, the air can circulate between the upper space 118, the lower space 119, and the refrigerator compartment interior circulation route 356.

Provided below the refrigerator compartment interior circulation route 356 (i.e., in the back of the lower space 119) is a temperature-humidity sensor 343. Hence, preferably, the temperature-humidity sensor 343 is slightly apart from the cooling plate 327, and positioned to be able to detect the temperature of the air stirred by the refrigerator compartment fan 142 and then passing near the cooling plate 327. An example of such a position includes the inside or the neighborhood of the low-temperature room. Since the temperature-humidity sensor 343 is provided in such a position, the two temperature sensors (i.e., the temperature-humidity sensor 243 and the cooling plate temperature sensor 244) described, for example, in the second embodiment can be combined into one temperature sensor.

Figure 8:
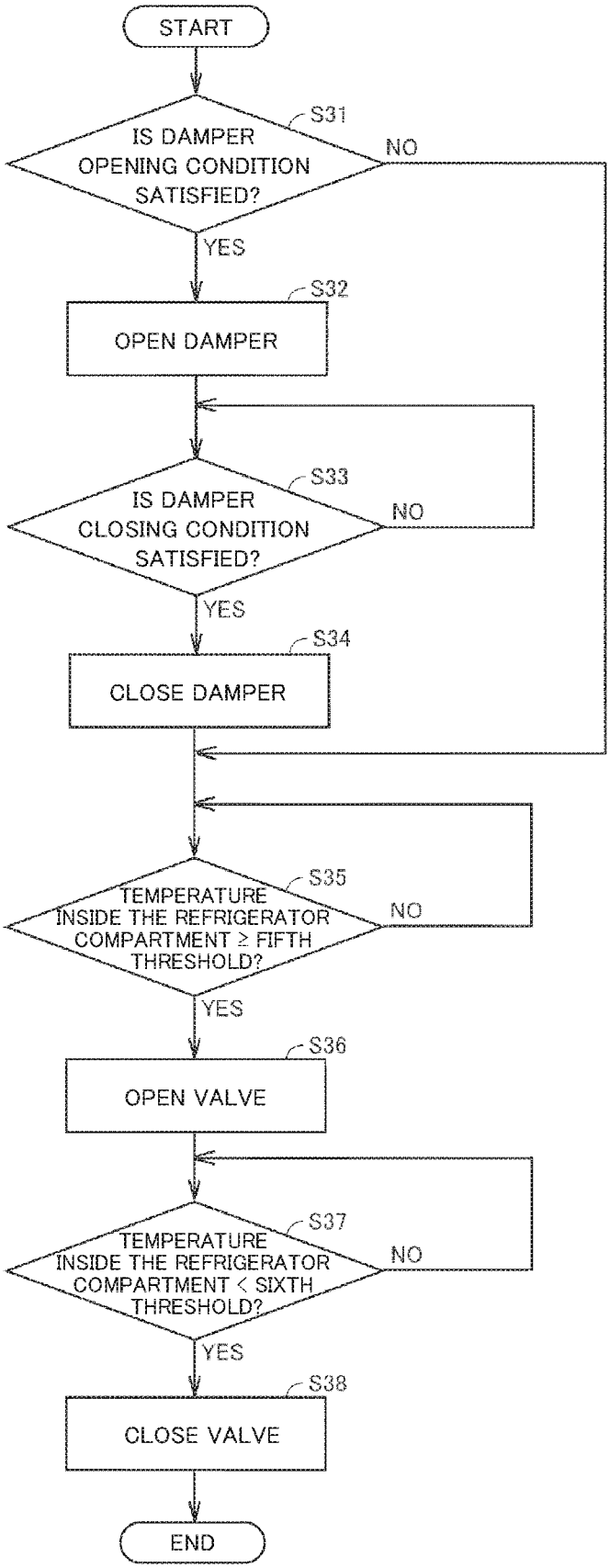
FIG. 8 is a flowchart showing a flow of processing to control temperature and humidity inside the refrigerator compartment of the refrigerator according to the third embodiment.

Described below is an example of how to control the temperature and the humidity of the refrigerator compartment 11 with reference to FIG. 8. Moreover, FIG. 8 shows an example of how to control the temperature and the humidity inside the refrigerator compartment 11. In the exemplary explanation in FIG. 8, the r e for compartment delivery damper 141 is initially closed and the valve 25 is initially closed.

First, the controller 29 determines whether a condition to open the refrigerator compartment delivery damper 141 (a damper opening condition) is satisfied (Step S31). Here, as seen in the second embodiment, the damper opening condition is satisfied if either condition; namely the condition (A) or the condition (B) described above, is satisfied (an OR condition).

In Step S31, if the damper opening condition is not satisfied (NO in Step S31), the refrigerator compartment delivery damper 141 is kept closed. The processing proceeds to Step S35.

Meanwhile, if the damper opening condition is satisfied (YES in Step S31), the refrigerator compartment delivery damper 141 is opened (Step S32). When the refrigerator compartment delivery damper 141 is opened, the cooled air generated inside the cooling room 15 flows through the cooled air delivery passage 16 into the refrigerator compartment 11. Hence, the temperature inside the refrigerator compartment 11 quickly falls.

Then, the controller 29 determines whether a condition to close the refrigerator compartment delivery damper 141 (a damper closing condition) is satisfied (Step S33). Here, as seen in the second embodiment, the damper closing condition is satisfied if both of the conditions; namely the condition (C) and the condition (D) described above, are satisfied (an AND condition). Moreover, in another embodiment, the damper closing condition may be satisfied if either the condition (C) or the condition (D) is satisfied (are OR condition).

In Step S33, if the damper closing condition is not satisfied (NO in Step S33), the refrigerator compartment delivery damper 141 is kept open.

After that, if the damper closing condition is satisfied (YES in Step S33), the controller 29 turns the refrigerator compartment delivery damper 141 from open to closed (Step S34).

Then, the processing proceeds to Step S35. In the processing subsequent to Step S35, the controller 29 controls the opening and closing of the valve 25, based on the temperature measured by the temperature-humidity sensor 343.

In Step S35, the controller 29 determines whether the temperature inside the refrigerator compartment 11 is higher than or equal to a predetermined temperature (a fifth threshold) (Step S35). If the temperature of the refrigerator compartment 11 is lower than the fifth threshold (NO in Step S35), the valve 25 is kept closed. Then, the controller 29 repeats the processing in Step S35.

Then, if the temperature inside the refrigerator compartment 11 rises higher than or equal to the fifth threshold, (YES in Step S35), the controller 29 turns the valve 25 from closed to open (Step S36). Hence, the refrigerant in the freezing cycle 20 circulates also in the second route, and the cooling plate 327 is cooled. As a result, the temperature inside the refrigerator compartment 11 gradually falls.

The controller 29 continues to monitor the temperature inside the refrigerator compartment 11, and determines whether the temperature inside the refrigerator compartment 11 falls below a predetermined temperature (a sixth threshold) (Step S37). If the temperature inside the refrigerator compartment 11 is higher than or equal to the sixth threshold (NO in Step S37), the valve 25 is kept open. Then, the controller 29 repeats the processing in Step S37.

After that, if the temperature inside the refrigerator compartment 11 falls below the sixth threshold, (YES in Step S37), the controller 29 turns the valve 25 from open to closed (Step S38). The closed valve 25 stops the supply of the refrigerant to the second route in the freezing cycle 20. Hence, the decrease in the temperature of the cooling plate 327 stops, and then, the temperature of the cooling plate 327 starts rising.

As can be seen, the controller 29 controls the opening and closing of the valve 25 in the freezing cycle 20 and of the refrigerator compartment delivery damper 141, thereby maintaining the temperature and the humidity inside the refrigerator compartment 11 in an appropriate condition.

In the above processing, the first threshold of the dew point is also referred to as a damper opening dew point. The damper opening dew point may be set to 1° C., for example. Moreover, the second threshold of the temperature inside the refrigerator compartment is also referred to as a damper opening refrigerator compartment temperature. The damper opening refrigerator compartment temperature may be set to 11° C., for example. Furthermore, the third threshold of the dew point is also referred to as a damper closing dew point. The damper closing dew point may be set to −1° C., for example. In addition, the fourth threshold of the temperature inside the refrigerator compartment is also referred to as a damper closing refrigerator compartment temperature. The damper closing refrigerator compartment temperature may be set to 7° C., for example. Furthermore, the fifth threshold of the temperature inside the refrigerator compartment is also referred to as a valve opening temperature. The valve opening temperature may be set to 5° C., for example. In addition, the sixth threshold of the temperature inside the refrigerator compartment is also referred to as a valve closing temperature. The valve closing temperature may be set to 2° C., for example.

In this embodiment, the opening and closing of the valve 25 is controlled based on the temperature measured inside the refrigerator compartment 11 by the temperature-humidity sensor 343. Thus, compared with the second embodiment in which the temperature of the cooling plate 127 is detected, the valve opening temperature and the valve closing temperature may be set relatively high. Moreover, the damper opening dew point is desirably lower than the valve closing temperature (or the lowermost temperature of the cooling plate 127). Hence, the inside of the refrigerator compartment 11 is cooled by the cooling plate 327 whenever possible. When the humidity, and then the dew point, inside the refrigerator compartment 11 rise, the dew point is decreased by the cooled air inside the cooling room 15. Such a feature reduces the risk that the cooled air at low humidity inside the cooling room 15 excessively flows into the refrigerator compartment 11, making it possible to keep the inside of the refrigerator compartment 11 from drying.

Figure 9:
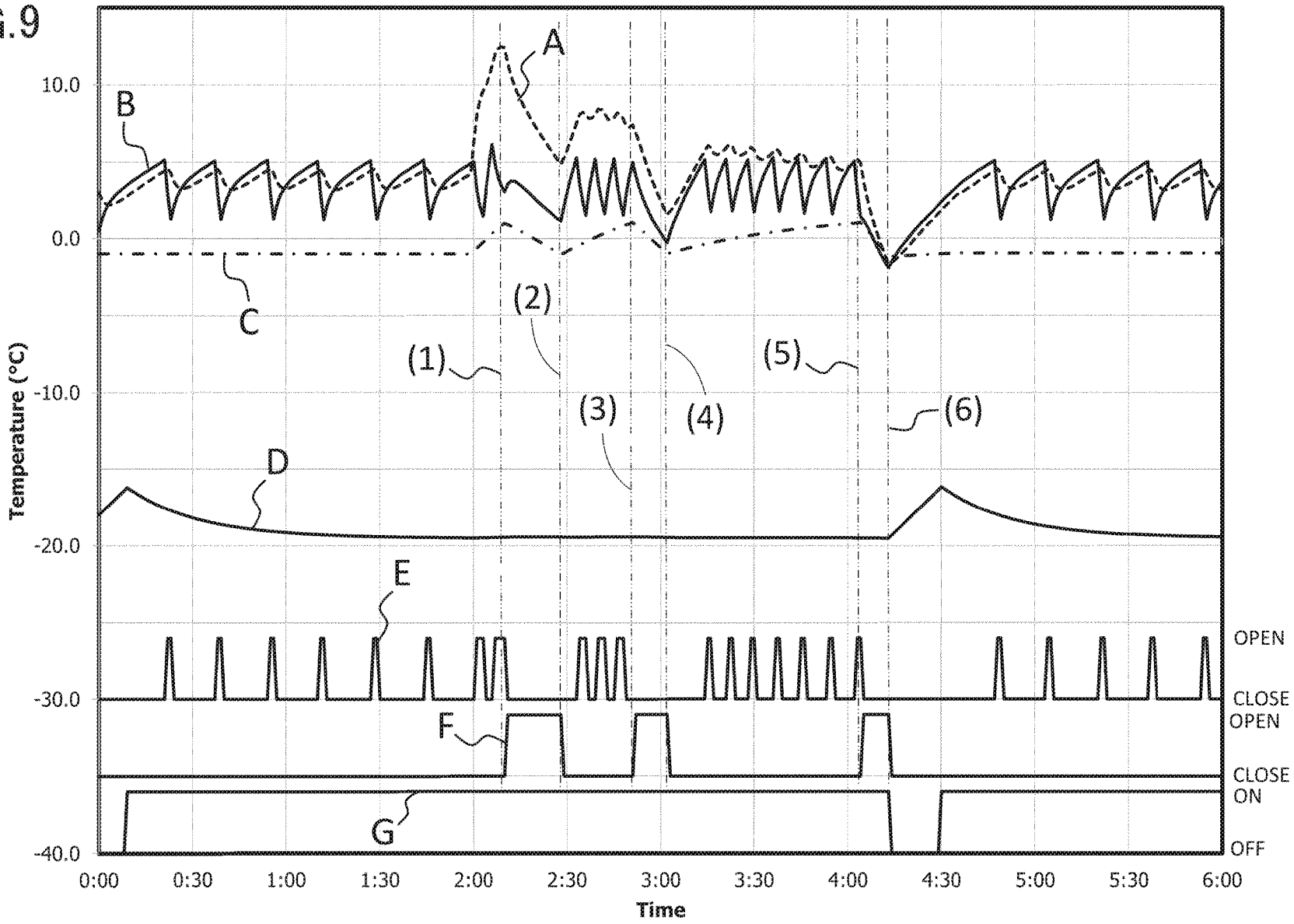
FIG. 9 is a graph illustrating temporal changes in temperature and dew point of compartments and a cooling plate, and states of components in the refrigerator according to the third embodiment.

FIG. 9 illustrates an example of changes in temperature of compartments and a cooling plate and in dew point of the refrigerator compartment 11, when the opening and closing of the refrigerator compartment delivery damper 141 and the valve 25, and ON and OFF of the operation of the compressor 22 are controlled, using the above control technique. In FIG. 9, the reference sign A denotes a temperature of the refrigerator compartment 11 (i.e., a temperature measured by the temperature-humidity sensor 343), the reference sign B denotes a temperature of the cooling plate 327, the reference sign C denotes a dew point of the refrigerator compartment 11 (i.e., a dew point calculated from the temperature and the humidity measured by the temperature-humidity sensor 343), and the reference sign D denotes a temperature of the freezer compartment 12. Moreover, the reference sign E denotes opening and closing of the valve 25, the reference sign F denotes opening and closing of the refrigerator compartment delivery damper 141, and the reference sign G denotes an operation state of the compressor 22.

In FIG. 9, time points (1), (3), and (5) are an example when to open the refrigerator compartment delivery damper 141 (i.e., time points when to send, to the refrigerator compartment 11, the cooled air subjected to heat exchange by the freezer compartment evaporator 21). As illustrated in the graph of FIG. 9, the refrigerator compartment delivery damper 141 is turned from closed to open when the dew point reaches a predetermined temperature (1° C., for example).

In FIG. 9, time points (2), (4), and (6) are an example when to close the refrigerator compartment delivery damper 141 (i.e., time points when to stop the flow of the cooled air, subjected to heat exchange by the freezer compartment evaporator 21, to the refrigerator compartment 11). As illustrated in the graph of FIG. 9, the refrigerator compartment delivery damper 141 is turned from open to closed when the temperature and the humidity of the refrigerator compartment 11 falls below predetermined values (i.e., when the above conditions (C) and (D) are satisfied).

As seen in this embodiment, the temperature-humidity sensor 343 is positioned in the lower space 119 (or, near the lower space 119) whose temperature is set lower. In this position, the temperature-humidity sensor 343 can accurately detect the temperature and the humidity of the lower space 119. Thus, the lower space 119 can be maintained a condition at a relatively high humidity and at a low temperature which is not excessively low to keep from freezing. Hence, the lower space 119 can be beneficially used as a space to preserve vegetables. Moreover, in the refrigerator compartment 11, the lower space 119 is set to have a low temperature and a high humidity. Such a feature makes it possible to control the opening and closing of the refrigerator compartment delivery damper 141 and of the valve 25, based on the temperature detected by one temperature sensor provided in (or near) the lower space 119. Note that the configuration in which the temperature-humidity sensor 343 is placed in the position illustrated in FIG. 7 is an example of a configuration in which a temperature-humidity sensor is placed in a low-temperature room.

Moreover, when the temperature and the humidity of the refrigerator compartment 11 are controlled, as illustrated in FIG. 9, the temperature (B) of the cooling plate 327 is preferably maintained higher than the dew point (C) of the refrigerator compartment 11. Such a feature makes it possible to minimize condensation formed on the cooling plate 327. Hence, produce to be stored in the lower space 119 such as vegetables is kept from dew, such that the vegetables are likely to be kept fresh.

Fourth Embodiment

Described next is a fourth embodiment of the present invention. The above embodiments describe a configuration which involves cooling the refrigerator compartment 11 by the direct-cooling, using a cooling plate cooled by the second cooler (the refrigerator compartment evaporator) provided in the second route of the freezing cycle 20. However, the technique to cool the refrigerator compartment using the direct-cooling shall not be limited to such a configuration. The fourth embodiment describes an example of a configuration which involves transmitting the cooled air inside the freezer compartment to a division wall between the refrigerator compartment and the freezer compartment, and using the division wall as a cooling plate.

Figure 10:
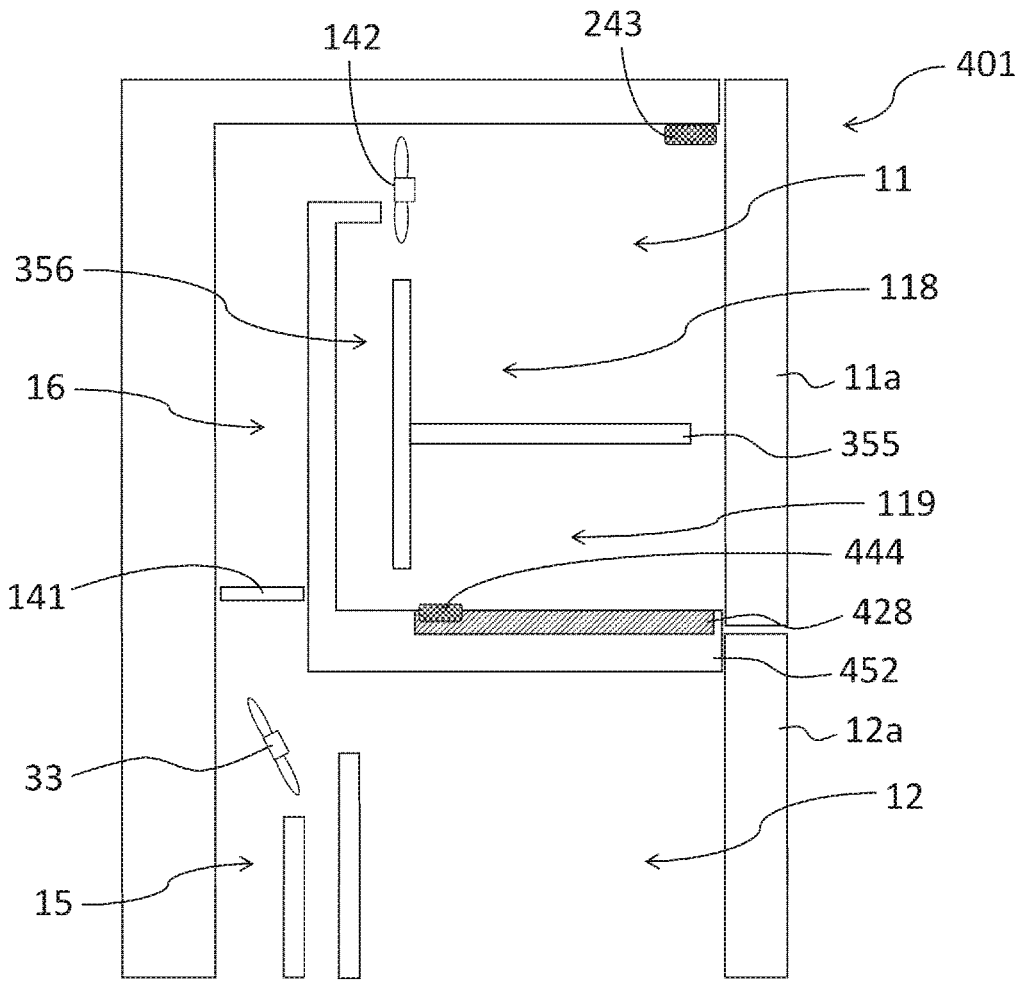
FIG. 10 is a cross-sectional view illustrating a configuration of surroundings of a refrigerator compartment in a refrigerator according to a fourth embodiment.

FIG. 10 illustrates an internal configuration of a refrigerator 401 according to the fourth embodiment. The refrigerator compartment 11 and the freezer compartment 12 are divided by a division wall 452. In the first embodiment, the refrigerator compartment 11 and the freezer compartment 12 are separated by the thermal insulation division wall 52 with high thermal insulation. Hence, not much cooled air is transmitted from the freezer compartment 12 through the thermal insulation division wall 52 to the refrigerator compartment 11. In contrast, the refrigerator compartment 11 and the freezer compartment 12 in this embodiment are divided by a division wall 452 lower in thermal insulation than the thermal insulation division wall 52.

Such a configuration makes it possible to transmit the cooled air inside the freezer compartment 12 to the refrigerator compartment 11, and cool the inside of the refrigerator compartment 11. That is, the division wall 452 acts as a cooling plate for cooling the inside of the refrigerator compartment 11 by the direct-cooling. Adoption of the direct-cooling in such a configuration eliminates the need of the second route in the freezing cycle 20, making it possible to simplify the configuration of the freezing cycle 20.

Note that if the cooled air inside the freezer compartment 12 is directly transmitted to the refrigerator compartment 11, the inside of the refrigerator compartment 11 might be excessively cooled. Hence, a temperature compensation heater 428 is provided to a face in the division wall 452 toward the refrigerator compartment 11. The temperature compensation heater 428 provided can maintain a surface of the division wall 452, positioned toward the refrigerator compartment 11, to have an appropriate temperature.

The refrigerator compartment 11 includes therein the temperature-humidity sensor 243 and a second temperature sensor 444. As seen in the second embodiment, the temperature-humidity sensor 243 is placed on the top face of the refrigerator compartment near the refrigerator compartment door 11*a* (i.e., near the access opening of the refrigerator compartment 11). Moreover, the second temperature sensor 444 is placed near the division wall 452 and the temperature compensation heater 428.

A temperature and a humidity inside the refrigerator compartment 11 detected by the temperature-humidity sensor 243 is mainly used for controlling opening and closing of the refrigerator compartment delivery damper 141. Moreover, a temperature detected by the second temperature sensor 444 is mainly used for turning ON and OFF the temperature compensation heater 428.

Figure 11:
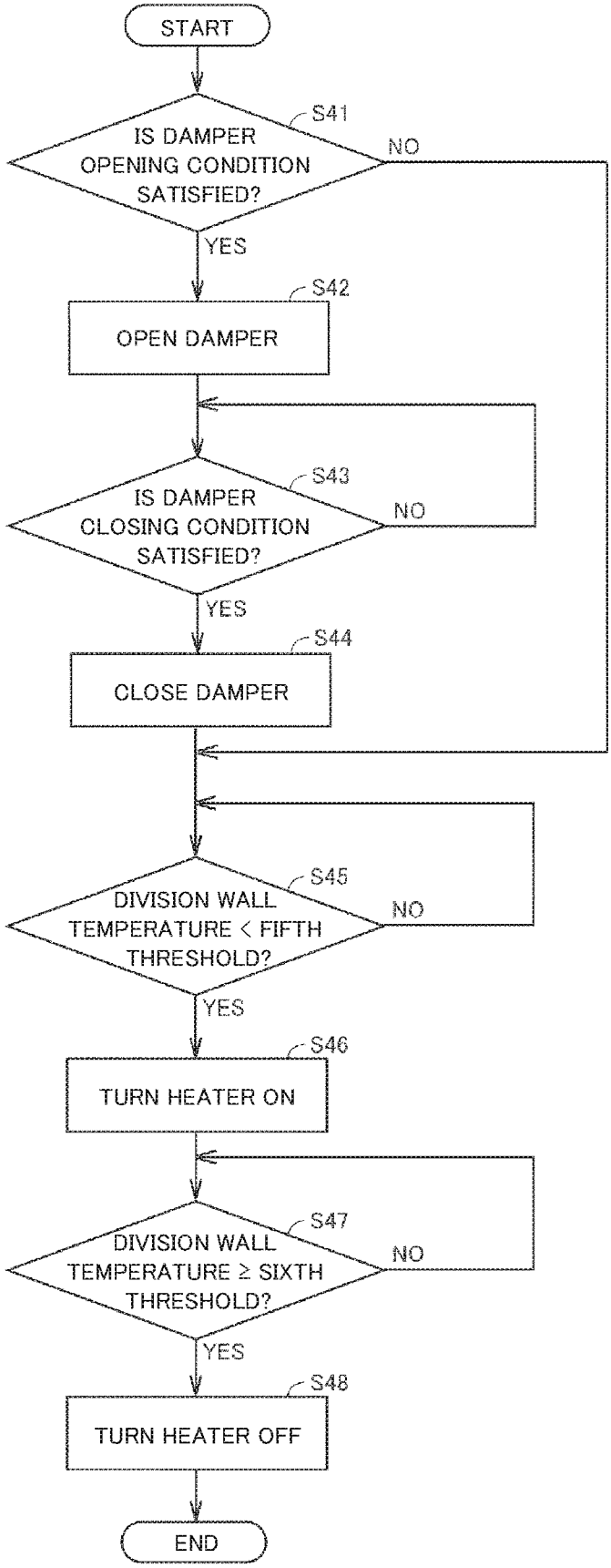
FIG. 11 is a flowchart showing a flow of processing to control temperature and humidity inside the refrigerator compartment of the refrigerator according to the fourth embodiment.

Described below is an example of how to control the temperature and the humidity of the refrigerator compartment 11 with reference to FIG. 11. Moreover, FIG. 11 shows an example of how to control the temperature and the humidity inside the refrigerator compartment 11. In the exemplary explanation in FIG. 11, the refrigerator compartment delivery damper 141 is initially closed and the temperature compensation heater 428 is initially OFF.

First, the controller 29 determines whether a condition to open the refrigerator compartment delivery damper 141 (a damper opening condition) is satisfied (Step S41). Here, as seen in the second embodiment, the damper opening condition is satisfied if either condition; namely the condition (A) or the condition described above, is satisfied (an OR condition).

In Step S41, if the damper opening condition is not satisfied (NO in Step S41), the refrigerator compartment delivery damper 141 is kept closed. The processing proceeds to Step S45.

Meanwhile, if the damper opening condition is satisfied (YES in Step S41), the refrigerator compartment delivery damper 141 is opened (Step S42). When the refrigerator compartment delivery damper 141 is opened, the cooled air generated inside the cooling room 15 flows through the cooled air delivery passage 16 into the refrigerator compartment 11. Hence, the temperature inside the refrigerator compartment 11 quickly falls.

Then, the controller 29 determines whether a condition to close the refrigerator compartment delivery damper 141 (a damper closing condition) is satisfied (Step S43). Here, as seen in the second embodiment, the damper closing condition is satisfied if both of the conditions; namely the condition (C) and the condition (D) described above, are satisfied (an AND condition). Note that, in another embodiment, the damper closing condition may be satisfied if either the condition (C) or the condition (D) is satisfied (an OR condition).

In Step S43, if the damper closing condition is not satisfied (NO in Step S43), the refrigerator compartment delivery damper 141 is kept open.

After that, if the damper closing condition is satisfied (YES in Step S43), the controller 29 turns the refrigerator compartment delivery damper 141 from open to closed (Step S44).

Then, the processing proceeds to Step S45. In the processing subsequent to Step S45, the controller 29 controls ON and OFF of the temperature compensation heater 428, based on the temperature measured by the second temperature sensor 444.

In Step S45, the controller 29 determines whether the temperature of the division wall 452 measured by the second temperature sensor 444 is lower than a predetermined temperature (a fifth threshold) (Step S45). If the temperature of the refrigerator compartment 11 is higher than or equal to the fifth threshold (NO in Step S45), the temperature compensation heater 428 is kept OFF. Then, the controller 29 repeats the processing in Step S45.

After that, if the temperature of the division wall 452 falls below the fifth threshold, (YES in Step S45), the controller 29 turns the temperature compensation heater 428 ON (Step S46). Hence, the heat of the temperature compensation heater 428 warms the surface of the division wall 452 facing the refrigerator compartment 11. Hence, the temperature inside the refrigerator compartment 11 gradually rises.

The controller 29 continues to monitor the temperature measured by the second temperature sensor 444, and determines whether the temperature inside the refrigerator compartment 11 rises higher than or equal to a predetermined temperature (a sixth threshold) (Step S47). If the temperature inside the refrigerator compartment 11 is lower than the sixth threshold (NO in Step S47), the temperature compensation heater 428 is kept ON. Then, the controller 29 repeats the processing in Step S47.

Then, if the temperature inside the refrigerator compartment 11 rises higher than or equal to the sixth threshold, (YES in Step S47), the controller 29 turns the temperature compensation heater 428 from ON to OFF (Step S48). Hence, the temperature rise of the division wall 452 stops. As a result, an excessive temperature rise inside the refrigerator compartment 11 is curbed, maintaining the temperature inside the refrigerator compartment 11 in an appropriate condition.

As can be seen, the controller 29 controls ON and OFF of the temperature compensation heater 428 and the opening and closing of the refrigerator compartment delivery damper 141, thereby maintaining the temperature and the humidity inside the refrigerator compartment 11 in an appropriate condition.

In the above processing, the first threshold of the dew point is also referred to as a damper opening dew point. The damper opening dew point may be set to 1° C., for example. Moreover, the second threshold of the temperature inside the refrigerator compartment is also referred to as a damper opening refrigerator compartment temperature. The damper opening refrigerator compartment temperature may be set to 7° C., for example. Furthermore, the third threshold of the dew point is also referred to as a damper closing dew point. The damper closing dew point may be set to −1° C., for example. In addition, the fourth threshold of the temperature inside the refrigerator compartment is also referred to as a damper closing refrigerator compartment temperature. The damper closing refrigerator compartment temperature may be set to 1° C., for example. In addition, the fifth threshold of the temperature of the division wall is also referred to as a heater ON temperature. The heater ON temperature may be set to −1° C., for example. In addition, the sixth threshold of the temperature of the division wall is also referred to as a heater OFF temperature. The heater OFF temperature may be set to 3° C., for example.

As can be seen, in the refrigerator compartment 401 according to this embodiment, the refrigerator compartment 11 and the freezer compartment 12 are divided by the division wall 452 lower in thermal insulation than the thermal insulation division wall 52. This configuration makes it possible to transmit the cooled air inside the freezer compartment 12 to the refrigerator compartment 11, and cool the inside of the refrigerator compartment 11. Such a feature eliminates the need of the second route of the freezing cycle 20 for cooling the cooling plate, making it possible to simplify the configuration of the freezing cycle 20.

Hence, the temperature compensation heater 428 is used to adjust the temperature of the surface of the division wall 452 acting as a cooling plate to cool the inside of the refrigerator compartment 11. As a result, the inside of the refrigerator compartment 11 can be maintained to have an appropriate temperature.

While there have been described what are at present considered to be certain embodiments of the invention, it will be understood that various modifications may be made thereto, and it is intended that the appended claim cover all such modifications as fall within the true spirit and scope of the invention.

What is claimed is:

1. A refrigerator comprising:

a first cooler;

a freezer compartment an inside of which is cooled by circulation of cooled air subjected to heat exchange by the first cooler;

a second cooler;

a refrigerator compartment cooled by direct-cooling, using a cooling plate cooled by the second cooler; and a temperature-humidity sensor configured to detect a temperature and a humidity of the refrigerator compartment, wherein the cooled air subjected to heat exchange by the first cooler is to be supplied to the refrigerator compartment if a dew point inside the refrigerator compartment rises higher than or equal to a predetermined temperature, and the predetermined temperature is lower than a lowermost temperature of the cooling plate.

2. The refrigerator according to claim 1, wherein the supply of the cooled air, subjected to heat exchange by the first cooler, to the refrigerator compartment stops if the temperature of the refrigerator compartment falls below the predetermined temperature.

3. The refrigerator according to claim 1, wherein the supply of the cooled air, subjected to heat exchange by the first cooler, to the refrigerator compartment stops if the humidity of the refrigerator compartment falls below a predetermined humidity.

4. The refrigerator according to claim 1, wherein the refrigerator compartment includes: a low-temperature room a temperature of which is set low; and a high-temperature room a temperature of which is set high, and the cooling plate is provided in the low-temperature room.

* * * * *